US010259623B2

(12) United States Patent
Bull

(10) Patent No.: US 10,259,623 B2
(45) Date of Patent: Apr. 16, 2019

(54) VALVE RETAINING DEVICE

(71) Applicant: OBRIST CLOSURES SWITZERLAND GMBH, Reinach (CH)

(72) Inventor: Martin Carey Bull, Tasburgh (GB)

(73) Assignee: Obrist Closures Switzerland GmbH, Reinach (CH)

( * ) Notice: Subject to any disclaimer, the term of this patent is extended or adjusted under 35 U.S.C. 154(b) by 0 days.

(21) Appl. No.: 15/284,531

(22) PCT Filed: Apr. 2, 2015

(86) PCT No.: PCT/EP2015/057352

§ 371 (c)(1),
(2) Date: Oct. 3, 2016

(87) PCT Pub. No.: WO2015/150537

PCT Pub. Date: Oct. 8, 2015

(65) Prior Publication Data

US 2017/0021983 A1 Jan. 26, 2017

(30) Foreign Application Priority Data

| | | |
|---|---|---|
| Apr. 3, 2014 | (GB) | 1406129.5 |
| Apr. 28, 2014 | (GB) | 1407398.5 |
| Apr. 28, 2014 | (GB) | 1407399.3 |

(51) Int. Cl.

| | |
|---|---|
| ***B65D 51/22*** | (2006.01) |
| ***B65D 35/46*** | (2006.01) |
| ***B65D 47/20*** | (2006.01) |

(52) U.S. Cl.

CPC ..... *B65D 47/2031* (2013.01); *B65D 35/46* (2013.01); *B65D 51/224* (2013.01); *B65D 2251/0093* (2013.01)

(58) Field of Classification Search

CPC ... B65D 47/2013; B65D 35/46; B65D 51/224

(Continued)

(56) References Cited

U.S. PATENT DOCUMENTS 5,115,950 A * 5/1992 Rohr ..... B65D 47/2031 215/232
5,676,289 A * 10/1997 Gross ..... B65D 47/2031 222/212

(Continued)

FOREIGN PATENT DOCUMENTS

BD WO 2011084766 7/2011 ..... B65D 47/20
EP 1531130 5/2005 ..... B65D 47/20

(Continued)

OTHER PUBLICATIONS

International Search Report and Written Opinion of the International Searching Authority, dated Jul. 3, 2015, International Patent Application No. PCT/EP2015/057352.

(Continued)

*Primary Examiner* — Vishal Pancholi
(74) *Attorney, Agent, or Firm* — Pollack, P.C.

(57) ABSTRACT

A device for retaining a self-closing valve in a closure is provided. The device comprises a body for receiving a self-closing valve and having a crimping flange capable of being bent from an uncrimped position to a crimped position so as to retain the valve in the device. The body is receivable into a closure with the valve retained. The crimping flange has a length, for instance, generally within a range of 0.5 mm and 4.0 mm.

16 Claims, 6 Drawing Sheets

(58) Field of Classification Search
USPC ..... 222/490, 493, 494, 496, 541.9, 547
See application file for complete search history.

(56) References Cited

U.S. PATENT DOCUMENTS

| | | | | |
|---|---|---|---|---|
| 5,788,108 | A * | 8/1998 | Rohr | B65D 47/08 215/238 |
| 6,006,960 | A * | 12/1999 | Gross | B65D 47/0809 220/258.5 |
| 6,371,340 | B1 | 4/2002 | Pateman et al. | 222/494 |
| 6,405,901 | B1 * | 6/2002 | Schantz | B65D 47/2031 222/213 |
| 8,640,928 | B2 * | 2/2014 | Ellenkamp-Van Olst | B65D 47/0809 137/843 |
| 2006/0037975 | A1 | 2/2006 | Suffa | B65D 35/38 |
| 2007/0295765 | A1 * | 12/2007 | Bull | B65D 47/2031 222/494 |

FOREIGN PATENT DOCUMENTS

| | | | |
|---|---|---|---|
| EP | 2181932 | 5/2010 | B65D 47/06 |
| GB | 2452595 | 3/2009 | B65D 47/20 |
| WO | WO 9858847 | 12/1998 | B65D 5/72 |
| WO | WO 03050008 | 6/2003 | B65D 25/40 |
| WO | WO 2006021509 | 3/2006 | B65D 47/20 |
| WO | WO 2011151611 | 12/2011 | B65D 47/20 |

OTHER PUBLICATIONS

UK Application Search Report, dated Aug. 27, 2014, UK Application No. GB 1407398.5.
UK Application Search Report, dated Aug. 27, 2014, UK Application No. GB 1407399.3.

* cited by examiner

VALVE RETAINING DEVICE

RELATED APPLICATIONS

This Application is the U.S. National Stage of International Patent Application No. PCT/EP2015/057352, filed Apr. 2, 2015, published in English, which designates the U.S., and claims priority under 35 U.S.C. §§ 119 and 365 to United Kingdom Application No. GB 1406129.5, filed Apr. 3, 2014, United Kingdom Application No. GB 1407398.5, filed Apr. 28, 2014, and United Kingdom Application No. GB 1407399.3, also filed Apr. 28, 2014. The disclosures of the above Applications are hereby incorporated by reference herein in their entireties.

FIELD OF THE DISCLOSURE

This disclosure relates generally to retaining arrangements and, more particularly, to a device for retaining a flexible valve and the like.

BACKGROUND OF THE DISCLOSURE

Flexible are commonly produced in a variety of forms, ranging from laminar-type relatively flexible membrane valves to silicon-based flexible valves which are generally non-laminar in shape. The construction of non-laminar, self-closing flexible-like valves for instance, generally comprises a concave or convex shaped head portion, with at least one slit, a side wall portion, and a flange.

Generally speaking, the term "laminar", as set forth this application, relates to forms which have a substantially uniform thickness with major surfaces being parallel to one another. The term "non-laminar" concerns forms which have a thickness that varies and in which the shape does not have major surfaces that are parallel to one-another.

Non-laminar valves are often used in association with closures which are themselves used in association with containers holding such consumable products as liquid soap and ketchup. They have the quality that when a user applies pressure to the container walls (for example by squeezing) the head portion of the valve responds to this increased pressure within the container by opening outwardly in the form of "petals". The fluid contained within the container then passes through the slit of the head portion of the valve. Further, the container walls are typically resilient such that when the user stops squeezing them, they move back to their original shape, thus increasing the volume within the container and, accordingly, reducing the pressure within the container. This reduced pressure sucks the open "petals" of the valve back to their original closed position. Such self-closing property is aided by the concave shape of the valve head.

According to one known method, to retain these valves within closures by means of retaining pieces, for example, the valve is first positioned within the closure at the relevant place and then a retaining piece is pushed over the valve until it snaps over a retaining bead within the closure. In this manner, the valve is held captive between the closure and the retaining piece.

Another conventional method of retaining such valves within closures involves positioning the valve within the closure and then bending a deformable ring, which forms part of the closure itself, over so that it crimps the valve in place. The valve is thus held captive against the closure by the crimped ring.

Containers that are used for holding and dispensing food products, such as ketchup, often have peelable foil membranes affixed over the mouth of the container that have to be removed prior to the first dispensing. To remove this foil, the user must first unscrew the closure from the container, then peel off the membrane, and finally re-screw the closure back onto the container. Once this has been carried out, the user may then squeeze the container and force the product through the valve and the associated spout or orifice situated in the closure, as discussed above.

It has been known, however, for some users to merely push a pen or other such object through the orifice of the closure, which then passes through the valve and, in turn, through the foil membrane underneath to pierce this foil without the need to remove the closure from the container. Although this may appear to save time, not only is hygiene a possible cause for concern, but more importantly it has been known for the pen or other such object to push the valve out from its crimped position, possibly by dislodging the retaining piece from the closure. The loose valve may then be dispensed along with product when the container is squeezed, since it is flexible enough to pass through the orifice. Furthermore, because the valve may be covered in product, it may be disguised and accordingly ingested by someone who was not aware it was there. Choking could result. The retaining piece, however, would not pass through the orifice since it is typically manufactured from harder material of a size that is greater than the size of the orifice.

Another common problem with these types of flexible valves is that because they are so supple, they are accordingly quite difficult to handle and position within the closure during assembly. This slows down assembly of the closures. Additionally, the valves have a tendency to stick to one another and, although talcum powder is used to reduce this problem, it can also slow closure assembly.

A device is, therefore, desired that overcomes problems associated with valve suppleness and flexibility so that it is not only impossible for valves, which become loose within containers, to pass through closure orifices, but also handleability may be improved to increase efficiency of the manufacture of closures.

OBJECTS AND SUMMARY OF THE DISCLOSURE

In accordance with one aspect of this disclosure is a device for retaining a self-closing valve in a closure, the device comprising a body for receiving a self-closing valve and having a crimping flange capable of being bent from an uncrimped position to a crimped position to retain the valve in the device by engaging a peripheral flange on the valve and thereby defining a flange height F in the crimped position, the body being receivable into a closure with the valve retained, wherein the crimping flange has a length H of approximately 1.4 mm; the peripheral flange height F is generally within a range of 1.25 mm and 2.5 mm; and the overall height of the device is about 6.40 mm, so as to collectively increase the rigidity of the peripheral flange and define an extended crimping profile for increasing by in excess of about 300% the force required to separate the self-closing valve from the retaining device.

According to another aspect of the disclosure is a device for retaining a self-closing valve in a closure, the device comprising a body for receiving a self-closing valve and having a crimping flange capable of being bent from an uncrimped position to a crimped position to retain the valve in the device by engaging a peripheral flange on the valve and thereby defining a flange height F in the crimped position, the body being receivable into a closure with the valve retained, wherein the crimping flange has a length H generally within a range of 1.0 mm and 2.50 mm; the peripheral flange height F is generally within a range of 1.25 mm and 2.50 mm; and the overall height of the device is generally within a range of 6.30 mm and 7.70 mm, so as to collectively increase the rigidity of the peripheral flange and define an extended crimping profile for increasing by in excess of about 200% the force required to separate the self-closing valve from the retaining device.

In accordance with a further aspect of the disclosure, a self-closing valve sub-assembly is provided, which comprises a retaining device in combination with a non-laminar, flange-presenting self-closing valve in a closure for a container, in which the closure is adapted for direct connection with the container, the device being separate from the closure for the container and separate from the container, the retaining device comprising a single piece article having a member for crimping the valve into the device prior to assembly, a crimping flange being separate from the closure for the container and separate from the container, the crimping member comprising the crimping flange capable of being bent from an uncrimped position to a crimped position, the crimping flange having a height of approximately 1.4 mm, the self-closing valve including a valve head and a peripheral flange engaged by the crimping flange in the crimped position, the self-closing valve having a weight generally within a range of 0.05 g and 0.11 g, in which the height of the valve peripheral flange is generally within a range of 1.25 mm and 2.5 mm, so as to collectively increase the rigidity of the peripheral flange and define an extended crimping profile having a selected flexibility for increasing by in excess of about 300% the force required to separate the self-closing valve from the retaining ring.

According to still another aspect of the disclosure, there is provided a device for retaining a self-closing valve in a closure, the device comprising a body for receiving a self-closing valve and having a crimping flange for bending from an uncrimped position to a crimped position so as to retain the valve in the device, the body being receivable in a closure with the valve retained, in which the crimping flange has a length generally within a range of 0.5 mm and 4.0 mm.

The crimping flange may have a length generally within a range 0.5 mm and 4.0 mm, for example, 1.0 mm and 2.50 mm.

The overall height of the device may be in the range 6.30 mm to 7.70 mm. In one embodiment, the height is approximately 5.95 mm; in another, the height is approximately 6.35 mm.

Yet another aspect of the disclosure provides a device for retaining a non-laminar, flange-presenting self-closing valve in a closure for a container in which the closure is adapted for direct connection with the container, the device being separate from the closure for the container and separate from the container, the device having a crimping flange for engaging the valve flange to retain the valve in the device, and the crimping flange being separate from the closure for the container and separate from the container, so that the device is fitted into the closure for the container with the retained valve, and the crimping flange having a height generally within a range of 1.10 mm and 2.50 mm.

The crimping flange height may, for example, be approximately 1.1, 1.2, 1.3, 1.4, 1.5, 1.6, 1.7, 1.8, 1.9, 2.0, 2.1, 2.2, 2.3, 2.4 or 2.5 mm.

The overall height of the device may be generally within a range of 5 mm and 8 mm, for example 6.30 mm and 7.70 mm. In one embodiment, the height is approximately 5.95 mm; in another, the height is approximately 6.35 mm.

The overall height of the device may be generally within a range 6.30 mm and 7.70 mm.

A further aspect of the disclosure provides a self-closing valve sub-assembly which comprises a retaining device in combination with a self-closing valve, the retention device comprising means for retaining a valve therein, the self-closing valve comprising a valve head and a peripheral flange which is engaged by the retaining means, in which the height of the peripheral flange is generally within a range of 1.25 mm and 2.5 mm.

The valve flange height may, for example, be approximately 1.25, 1.3, 1.35, 1.4, 1.45, 1.5, 1.55, 1.6, 1.65, 1.7 1.75, 1.8, 1.85, 1.9, 1.95, 2.0, 2.05, 2.1, 2.15, 2.2, 2.25, 2.3, 2.35, 2.4, 2.45, or 2.5 mm. In one embodiment, the flange is approximately 1.52 mm; in another embodiment, the height is approximately 2.03 mm.

Still another aspect of the disclosure provides a self-closing valve sub-assembly which comprises a retaining device in combination with a self-closing valve, the retention device including a single piece article having means for crimping a valve into the device prior to assembly, the crimping means comprising a crimping flange capable of being bent from an uncrimped position to a crimped position, the self-closing valve including a valve head and a peripheral flange engaged by the crimping flange in the crimped position, in which the height of the peripheral flange is generally within a range of 1.25 mm and 2.5 mm.

The valve flange height may, for example, be approximately 1.25, 1.3, 1.35, 1.4, 1.45, 1.5, 1.55, 1.6, 1.65, 1.7, 1.75, 1.8, 1.85, 1.9, 1.95, 2.0, 2.05, 2.1, 2.15, 2.2, 2.25, 2.3, 2.35, 2.4, 2.45, or 2.5 mm. In one embodiment, the flange is approximately 1.52 mm; in another embodiment, the height is approximately 2.03 mm.

Yet another aspect of the disclosure provides a self-closing valve sub-assembly having a retaining device in combination with a self-closing valve, the retaining device comprising means for retaining a valve therein, the self-closing valve having a weight generally within a range of 0.05 g and 0.11 g.

A further aspect is directed to a self-closing valve sub-assembly which includes a retaining device in combination with a self-closing valve, the retaining device comprising a single piece article having means for crimping a valve into the device prior to assembly, the crimping means including a crimping flange capable of being bent from an uncrimped position to a crimped position, the self-closing valve having a weight generally within a range of 0.05 g and 0.11 g.

The valve may, for example, have a weight of 0.05, 0.06, 0.07, 0.08, 0.09, 0.10 or 0.11 g.

The weight may, for example, be generally within a range of 0.05 g and 0.08 g, or 0.08 g and 0.11 g.

Still a further aspect of the disclosure concerns a self-closing valve sub-assembly, which comprises a valve retaining device as described herein and a flange-presenting self-closing valve as described herein, in combination with a closure for a container.

Where present, aspects and embodiments of the disclosure may comprise or include some or all of the following features.

Where present, the crimping flange aspects and embodiments of the disclosure may comprise an upstanding wall.

The device may comprise a circular upstanding wall and the crimping flange may comprise a circumferentially upstanding wall.

The device may include a bead for snap-fitting the device into a closure.

The device may comprise a sloping surface for receiving a valve flange.

The device may be formed as a retaining ring.

The device may be formed as a single-piece article.

The crimping flange may be adapted to engage a flange of a valve.

Devices or sub-assemblies may further comprise a sealing bead.

The device may be snap-fittable into a closure.

The device and a closure may include co-operating sealing beads for fixing the device into the closure.

The valve may be a non-laminar self-closing valve.

The device may be formed separately from a closure and also from a container.

The valve may comprise a flange, and the rigidity of the flange may be increased by the device.

The device may be retained within a closure by means of a mechanical and/or a chemical fit.

The valve may be retained in the device by being crimped in place.

Moreover, the valve may be retained in the device by being glued in place.

This disclosure also provides a retaining device as described herein, in combination with a non-laminar self-closing valve.

The disclosure additionally provides, in combination, a retaining device or assembly as described herein with a self-closing valve fitted and positioned in a closure.

The closure may comprise a wall for retaining the device in the closure.

The disclosure further provides a method of forming a self-closing valve preassembly for a container closure, comprising the steps of:

- providing a valve retaining device as described herein that is separate from the container closure in which the closure is adapted for direct connection with the container, and also from the container, the device having a crimping flange;
- providing a non-laminar self-closing valve, the valve having a flange;
- positioning the valve into the device;
- crimping the crimping flange over the valve flange to retain the valve in the device.

The device may have an annular support surface and in which the flange is supported on the support surface such that after crimping, the valve flange is trapped between the support surface and the crimping flange.

The crimping step may be performed without heating the crimping flange.

The crimping flange may be moveable from an uncrimped position. The crimping flange may be moved generally within a range of 80 degrees and 200 degrees, for instance, 90 degrees to 180 degrees. In some embodiments, the flange is moved substantially 90 degrees from the uncrimped position to the crimped position in the crimping set.

In addition, the method may comprise the step of fitting the valve preassembly into a closure.

The method may further comprise the step of fitting the closure including the valve preassembly to a container.

Valves according to this disclosure may be formed from silicon or a silicon-based material.

The valve may be formed from a thermoplastic vulcanisate (TPV) material.

The valve may be formed from a thermoplastic elastomer (TPE) material.

The valve may be formed from a rubber material, such as nitryl rubber.

Combinations of different materials are possible. Bi-injected valves are possible.

The disclosure also provides a closure fitted with a self-closing valve assembly as described herein.

Further embodiments are disclosed in the dependent claims attached hereto.

Different aspects and embodiments of the disclosure may be used separately or together, for example, a device with a crimping flange in the ranges specified in combination with a valve having a peripheral flange in the ranges specified and a weight in the ranges specified.

Further particular and preferred aspects of the disclosure are set forth in the accompanying independent and dependent claims. Features of the dependent claims may be combined with the features of the independent claims, as appropriate, and in combination other than those explicitly set out in the claims.

BRIEF DESCRIPTION OF THE DRAWINGS

A specific, illustrative, representative valve retaining device, according to the disclosure, is described below with reference to the accompanying drawings, in which.

The same numerals are used throughout the drawing figures to designate similar elements. Still other objects and advantages of the disclosure will become apparent from the following description of specific, illustrative embodiments.

DETAILED DESCRIPTION

Figure 1:
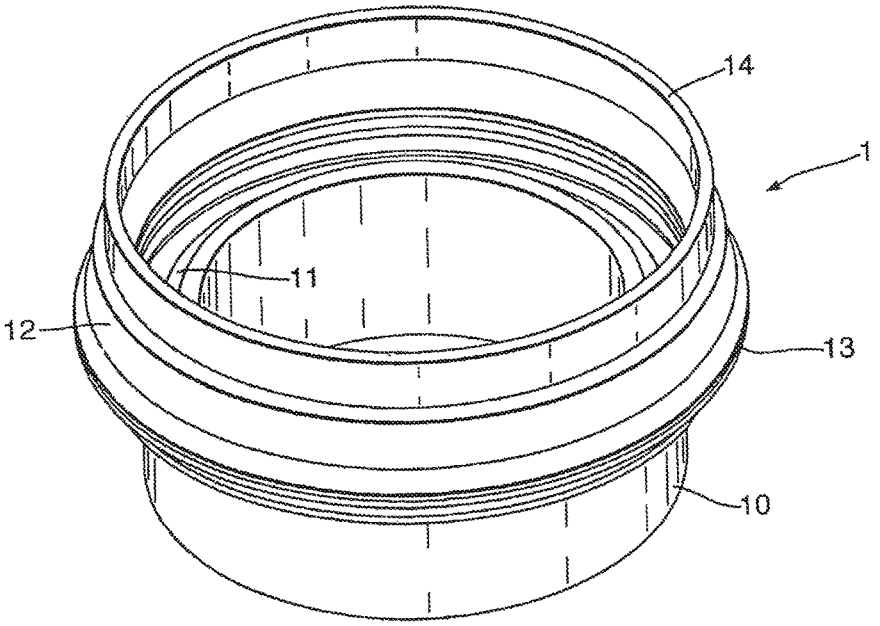
FIG. 1 is a perspective view of a device formed according to the disclosure without a valve in position.

In the following description, all orientational terms, such as upper, lower, radially and axially, are used in relation to the drawings and should not be interpreted as limiting this disclosure or connection to a closure.

Example embodiments are described below in sufficient detail to enable those of ordinary skill in the art to embody and implement the systems and processes herein described. It is important to understand that embodiments can be provided in many alternate forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed and as well as individual embodiments the disclosure is intended to cover combinations of those embodiments as well. On the contrary, all modifications, equivalents, and alternatives falling within the scope of the appended claims should be included. Elements of the example embodiments are consistently denoted by the same reference numerals throughout the drawings and detailed description where appropriate.

The terminology used herein to describe embodiments is not intended to limit the scope. The articles "a," "an," and "the" are singular in that they have a single referent however, the use of the singular form in the present document should not preclude the presence of more than one referent. In other words, elements referred to in the singular can number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

Referring now to the drawings and, more particularly, to FIG. 1 there is shown generally a device 1, referred to hereinafter as a retaining ring 1. The ring comprises a molded single-piece article with a "chimney" in the form of a circular wall 10. The chimney provides a surface for assembly machinery to handle the retaining ring. At one end of the chimney is a radially, outwardly sloping surface 11*a* on an annular wall 11. At the outer radial end of the sloping surface, there is provided another circular wall 12, which has the same rotational axis generally as chimney 10, and extends in an upward direction.

Along the circumference of a radially outer surface of wall 12 is a projection in the form of an external sealing bead 13. At an end of wall 12 is a crimping flange 14 which in its uncrimped condition is an upstanding wall which, in this embodiment, has a height H of approximately 1.1 mm. In a further embodiment, a wall with a height of approximately 1.4 mm is provided.

Figure 2:
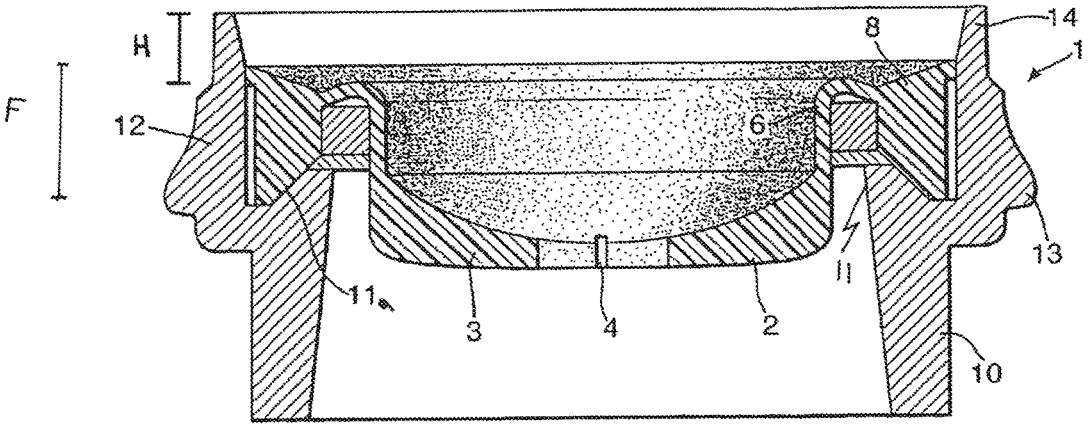
FIG. 2 is a sectional view of the device shown in FIG. 1 with a valve loosely in position.

A flexible self-closing valve 2 is provided which typically has the features shown in FIG. 2. For instance, such a valve 2 has a head portion 3, which is thicker towards the edge than the centre and which has at least one slit 4 therein. The head portion is concave with respect to a container (not shown).

A side-wall portion 6 connects head portion 3 with a flange 8. Flange 8 is typically shaped such that it has a relatively substantial size in the form of a rim. It is this flange 8 which rests on sloping surface 11 of retaining ring 1 when it is located correctly.

Figure 3:
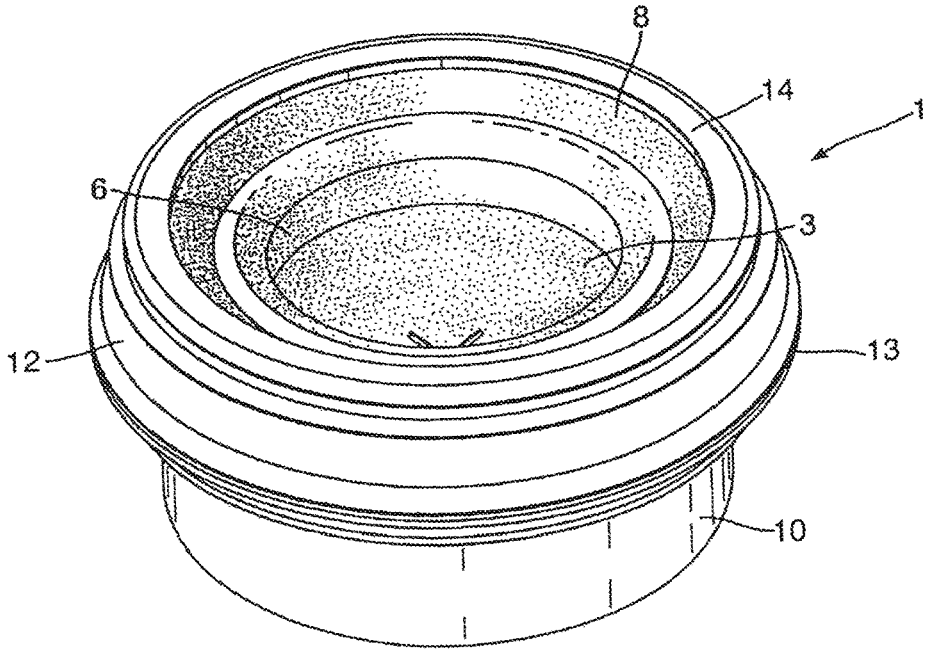
FIG. 3 is a perspective view of the device illustrated in FIG. 1 with a valve crimped in position.
Figure 4:
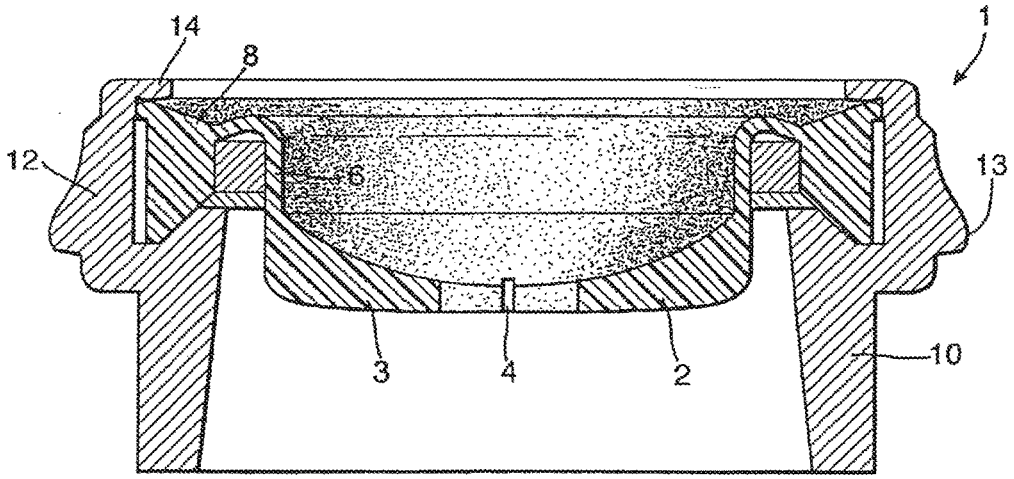
FIG. 4 shows a cross-section through the device set forth in FIG. 3 with a valve crimped in position.

In this embodiment, to crimp valve 2 in place, crimping flange 14 is bent over from the position shown in FIG. 2 until it sandwiches flange 8 between itself 14 and sloping surface 11, as shown in FIGS. 3 and 4.

Also shown is a valve 2 with crimping flange 14 bent over. Although crimping flange 8 is shown as being bent over by 90 degrees radially inward, it should be understood that the angle through which it must be bent is not fixed. For instance, it has been found that the crimping flange need only be bent over by a few degrees in order that it hold the valve in place within retaining ring 1. This is because the crimping flange is bent over along the entire circumference of retaining ring 1 and valve 2. Furthermore, crimping flange 14 could be bent over by more than 90 degrees so that it lies against and substantially parallel with the surface of flange 8.

Figure 5:
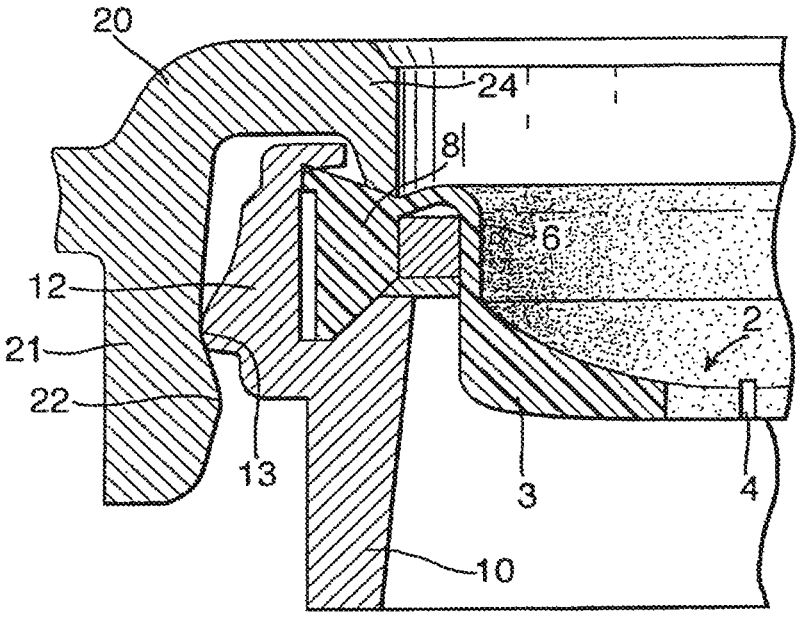
FIG. 5 is a sectional view of the device of FIG. 1 with a valve crimped into position and with the device positioned in a closure.

In FIG. 5, a retaining ring 1 is shown with a valve 2 crimped in place. In addition, the retaining ring is positioned within a closure 20. The closure has a circular wall 21 which has a rotational axis coincident with the axis of the retaining ring. Along the radially inner side of this wall 21 is a sealing bead 22 in the form of a projection.

At the upper end of wall 21 is another wall 24 which lies perpendicular to wall 21. This wall 24 extends radially inward from wall 21.

When retaining ring 1 is fitted to closure 20, it is pushed into the closure until crimping flange 14 meets the underside of wall 24. Further, sealing bead 13, on the radially outer side of wall 12 of the retaining ring, is provided such that it has an external diameter greater than that of the diameter of the radially inner surface of sealing bead 22. Accordingly, the retaining ring snap-fits into the closure so that the two sealing beads 13, 22 form an interference seal in a manner well known in the art.

Alternative or additional methods of fitting retaining ring 1 in closure 20 are, of course, possible. Such methods could include glueing, corresponding screw threads and chemical means.

Additionally, although valve 2 has been shown in this embodiment to be crimped into retaining ring 1, in other embodiments it would be possible to glue or affix the valve to the retaining ring by other means such as by chemical means.

Further still, it has been found that contrary to expectation, it has been possible to bend crimping flange 14 over without the need to apply heat to soften the material.

Furthermore, although only one valve 2 has been discussed, it would be possible to design a retaining ring 1 which could have more than one valve 2 crimped into it. This might be useful if it was desired to have a closure with more than one dispensing orifice.

Although the advantages of the above described retaining ring have already been discussed, (e.g., improved rigidity to improve handleability and prevent accidental passing of valve 2 through an orifice of a closure), further advantages may be achieved. One such advantage is that the valve and retaining ring may be pre-assembled on a different production machine than the machines which are used to produce the closures or assemble the closures, if different therefrom. Further, because the valves and retaining ring can be assembled more quickly than the closure can be produced or assembled, a stock of these pre-assembled valves and retaining rings can be maintained, with obvious benefits.

Another advantage of the disclosure is that the rigidity of the flange of the valve is increased.

Figure 6:
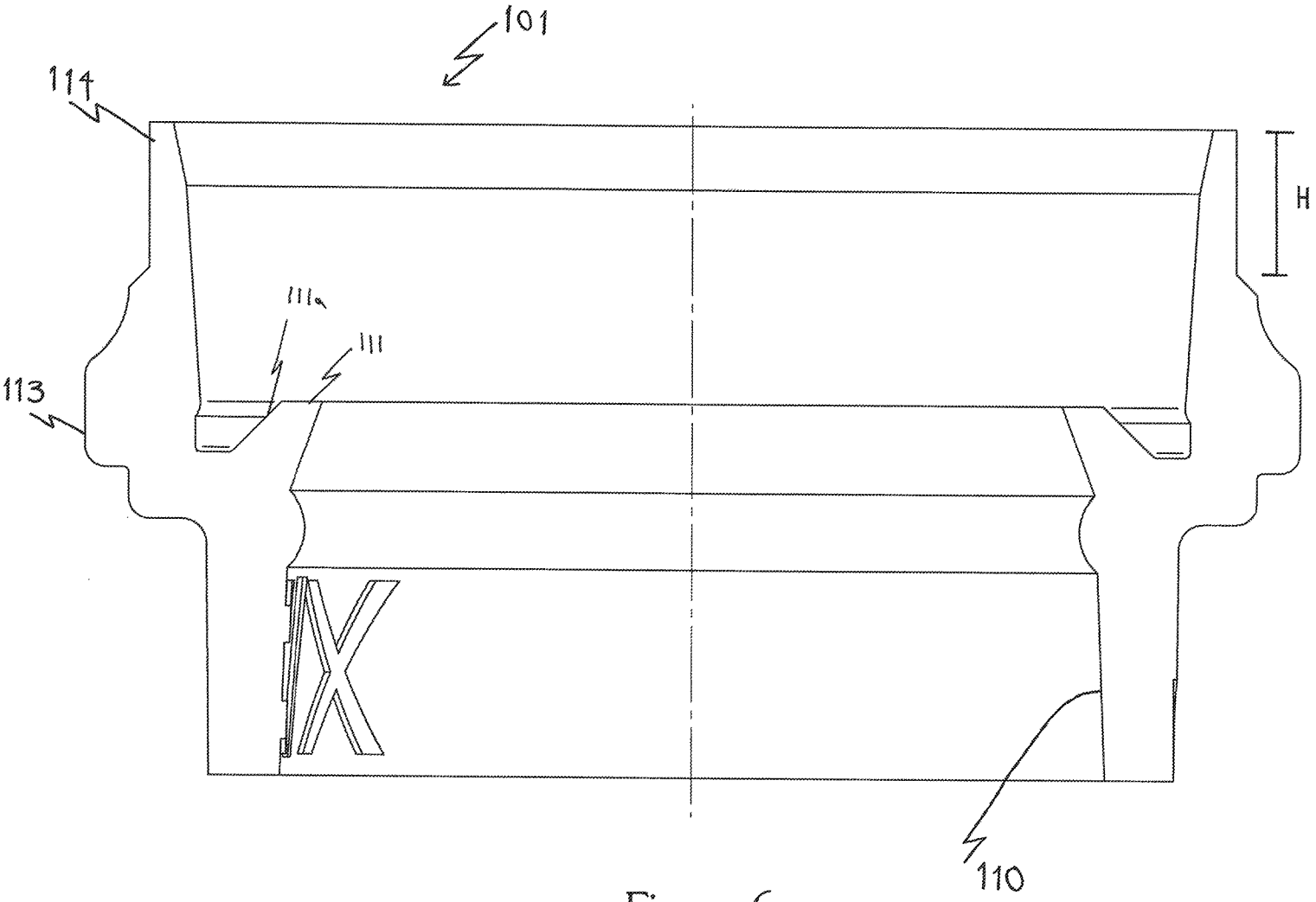
FIG. 6 is a sectional view of a device formed in accordance with another aspect of the disclosure.

In FIG. 6, a ring on 101 formed according to an alternative embodiment is shown. The ring is generally the same as ring 1 shown in FIGS. 1-5, except that the length H of crimping flange 114 is approximately 1.4 mm, with an overall ring height of approximately 6.40 mm.

It has been found that this flange length gives particular benefits to the force required to pull the valve out of a sub-assembly, by greatly increasing the force required, in some embodiments by in excess of a 300% increase in valve pull out force.

The ring benefits from several beneficial features: i) extended crimping profile design—which will improve component processing quality, and increased valve pull out forces to improve transportation quality; ii) side bead 113 vertical increase—which allows a better ring feed into an assembly machine, thus giving better processing efficiencies; and iii) redesigned chimney 110 inside diameter—which allows a greater flexibility for the valve sub-assembly to closure assembly machines.

Figure 7:
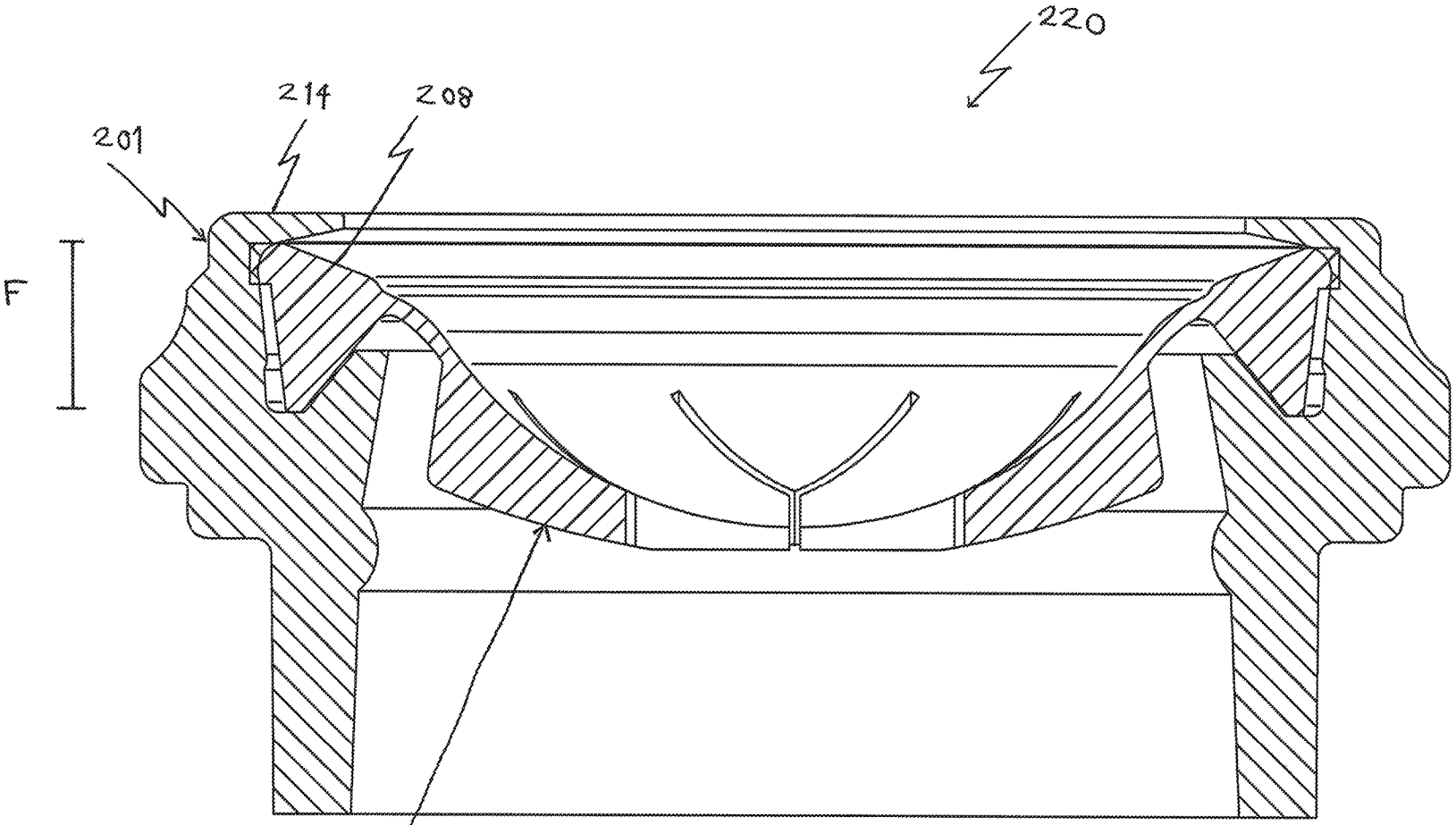
FIG. 7 shows the device of FIG. 6 fit with a valve, according to a further aspect of the disclosure.

Referring now to FIG. 7, a valve sub-assembly 220 is shown. In this embodiment, a retention ring 201 is provided that is generally the same as that shown in FIG. 6. More particularly, the ring is combined with a valve 202 which is generally similar to valve 2 shown in FIGS. 2-5. However, in this embodiment the height F of flange 208 is significantly less, being approximately 1.52 mm.

In other embodiments (not shown), a reduced height flange may be used in combination with a retaining ring but without an extended crimping flange.

Figure 8:
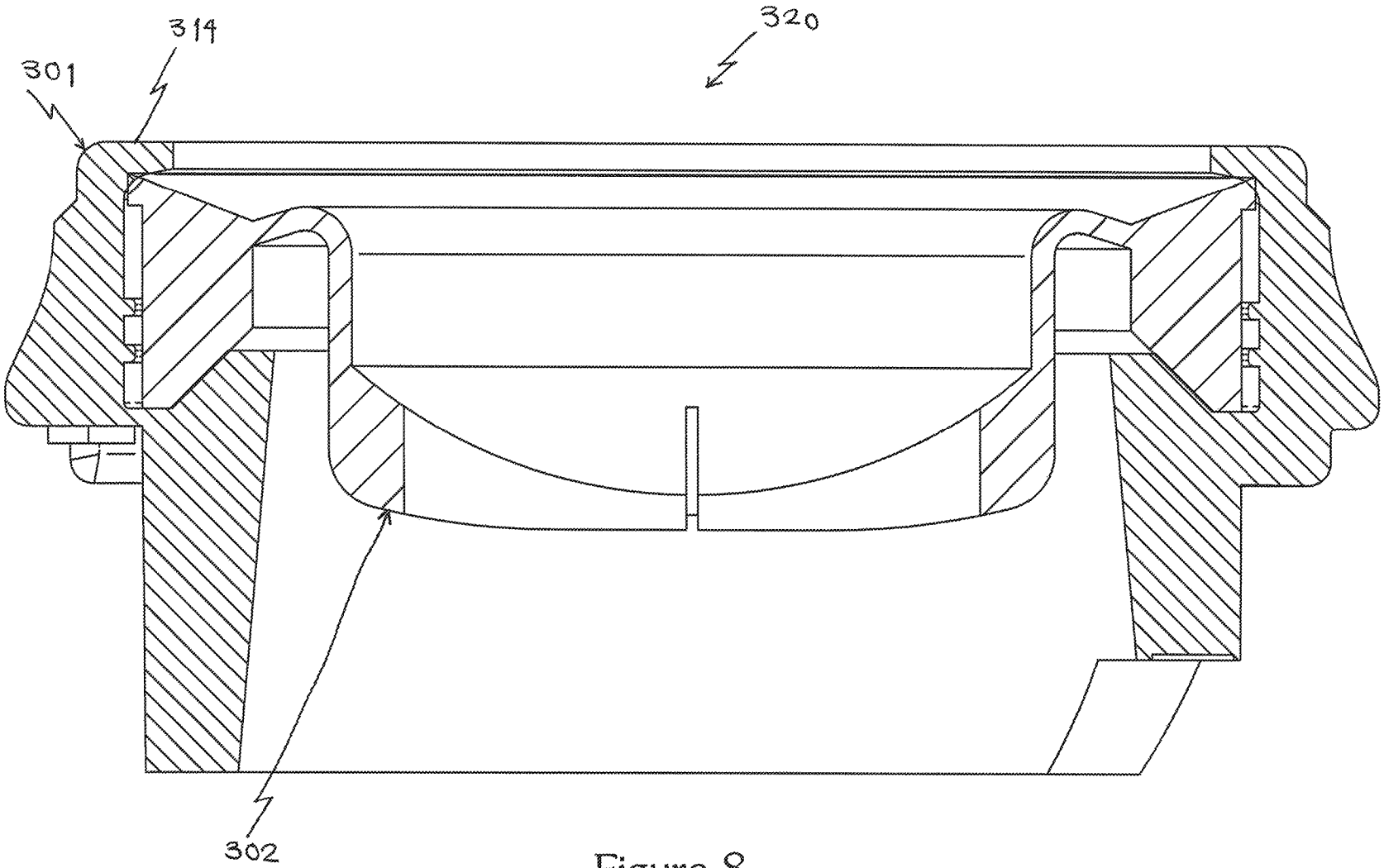
FIG. 8 is a sectional view of a valve sub-assembly formed according to still another aspect of the disclosure.

Shown in FIG. 8 is a sub-assembly 320 formed according to an alternative embodiment. A valve 302 is fitted into a retention ring 301, the valve having a weight of approximately 0.06 g. The ring has a crimping flange 314 with a height H of approximately 1.0 mm. The overall height of ring 301 is approximately 6.05 mm.

In this embodiment, the ring is a device for retaining a non-laminar, flange-presenting self-closing valve in a closure for a container. The closure (not shown) is directly attachable to a container. The valve is mounted within the retainer device by the crimping flange. In so doing, the crimping flange extends entirely around the outer flange of the valve. The retainer device is separate from the closure which is used to close the container. As such, the closure is adapted for direct connection with the container. A lid (not shown) may also be associated with the closure. This lid may be either separate from the closure or attached to the closure.

Although specific, illustrative embodiments have been disclosed in detail herein, with reference to the accompanying drawings, it is understood that the invention is not limited to the precise embodiments shown and that various changes and modifications can be effected therein by one skilled in the art without departing from the spirit and scope of the disclosure as defined by the appended claims and their equivalents.

The invention claimed is:

1. A device for retaining a self-closing valve in a closure, the device comprising a body for receiving a self-closing valve and having a crimping flange capable of being bent from an uncrimped position to a crimped position to retain the valve in the device by engaging a peripheral flange on the valve and thereby defining a flange height F in the crimped position, the body being receivable into a closure with the valve retained, wherein the crimping flange has a length H of approximately 1.4 mm; the peripheral flange height F is generally within a range of 1.25 mm and 2.5 mm; and the overall height of the device is about 6.40 mm, so as to collectively increase the rigidity of the peripheral flange and define an extended crimping profile for increasing by in excess of about 300% the force required to separate the self-closing valve from the retaining device.

2. The device set forth in claim 1, wherein the crimping flange has a length generally within a range of 1.10 mm and 2.5 mm.

3. The device set forth in claim 1, wherein the overall device height is generally within a range of 5 mm and 8 mm.

4. A device for retaining a self-closing valve in a closure, the device comprising a body for receiving a self-closing valve and having a crimping flange capable of being bent from an uncrimped position to a crimped position to retain the valve in the device by engaging a peripheral flange on the valve and thereby defining a flange height F in the crimped position, the body being receivable into a closure with the valve retained, wherein the crimping flange has a length H generally within a range of 1.0 mm and 2.50 mm; the peripheral flange height F is generally within a range of 1.25 mm and 2.50 mm; and the overall height of the device is generally within a range of 6.30 mm and 7.70 mm, so as to collectively increase the rigidity of the peripheral flange and define an extended crimping profile for increasing by in excess of about 200% the force required to separate the self-closing valve from the retaining device.

5. The device set forth in claim 1, wherein the overall height of the device is either approximately 5.95 mm or approximately 6.35 mm.

6. The device set forth in claim 1, wherein the crimping flange comprises an upstanding wall.

7. The device set forth in claim 1, further comprising a circular upstanding wall and the crimping flange comprises a circumferentially upstanding wall.

8. The device set forth in claim 1, further having an external side bead for snap-fitting the device into a closure.

9. The device set forth in claim 1, further including a sloping surface for receiving a valve flange.

10. The device set forth in claim 1, further formed as a retaining ring.

11. The device set forth in claim 1, further formed as a single-piece article.

12. The device set forth in claim 4, wherein the self-closing valve has a weight generally within a range of 0.05 g and 0.11 g.

13. The device set forth in claim 4, wherein the assembly weight is generally within a range of 0.08 g and 0.11 g.

14. The device set forth in claim 4, wherein the assembly weight is generally within a range of 0.05 g and 0.08 g.

15. The device set forth in claim 4, wherein the valve is formed of a material selected from a group consisting essentially of silicon or a silicon-based material, a rubber material, TPV, or TPE.

16. A self-closing valve sub-assembly comprising a retaining device in combination with a non-laminar, flange-presenting self-closing valve in a closure for a container, in which the closure is adapted for direct connection with the container, the device being separate from the closure for the container and separate from the container, the retaining device comprising a single piece article having a member for crimping the valve into the device prior to assembly, a crimping flange being separate from the closure for the container and separate from the container, the crimping member comprising the crimping flange capable of being bent from an uncrimped position to a crimped position, the crimping flange having a height of approximately 1.4 mm, the self-closing valve including a valve head and a peripheral flange engaged by the crimping flange in the crimped position, the self-closing valve having a weight generally within a range of 0.05 g and 0.11 g, in which the height of the valve peripheral flange is generally within a range of 1.25 mm and 2.5 mm, so as to collectively increase the rigidity of the peripheral flange and define an extended crimping profile having a selected flexibility for increasing by in excess of about 300% the force required to separate the self-closing valve from the retaining ring.

* * * * *